United States Patent [19]

Ikeda et al.

[11] 4,317,466

[45] Mar. 2, 1982

[54] HYDRAULIC DRIVE CIRCUIT FOR LOAD-HANDLING MACHINES

[75] Inventors: Akinori Ikeda, Chiba; Fuyuki Nagai, Saitama; Takashi Okuno, Ibaraki, all of Japan

[73] Assignee: Hitachi Construction Machinery Co., Ltd., Tokyo, Japan

[21] Appl. No.: 136,391

[22] Filed: Apr. 1, 1980

[30] Foreign Application Priority Data

Apr. 5, 1979 [JP] Japan ..... 54-40339

[51] Int. Cl.[3] ..... F15B 13/02

[52] U.S. Cl. ..... 137/115; 91/451; 137/596.12

[58] Field of Search ..... 91/451; 137/115, 596.12

[56] References Cited

U.S. PATENT DOCUMENTS 3,416,561 12/1968 Kokaly ..... 91/451 X

FOREIGN PATENT DOCUMENTS 2015013 10/1971 Fed. Rep. of Germany .
2212179 10/1972 Fed. Rep. of Germany .
939296 10/1963 United Kingdom .

OTHER PUBLICATIONS

German Publication "Olhydraulik und Pneumatik", 1967, vol. 11, No. 2, p. 61, portion relating to FIG. 11.

*Primary Examiner*—Gerald A. Michalsky
*Attorney, Agent, or Firm*—Wenderoth, Lind & Ponack

[57] ABSTRACT

A hydraulic drive circuit for a load-handling machine such as hydraulic crawler crane, shovel or the like in which the maximum output pressure of the circuit is determined by a main relief valve provided on the delivery side of a hydraulic pump. The drive circuit is capable of producing a surge of power or output by automatically increasing the relief pressure of the main relief valve above a rated pressure of the circuit for a short time period of about a few seconds, when required for extracting an implanted pile, for pulling a bucket which is caught on a large stone, or for getting a machine out of a muddy spot. At the end of the predetermined time period, the circuit pressure is automatically returned to the level of the rated pressure. The surge output is from 130% to 150% of the rated output but allows use of hydraulic components or an engine of a capacity designed for the rated output without troubles or engine stops.

10 Claims, 9 Drawing Figures

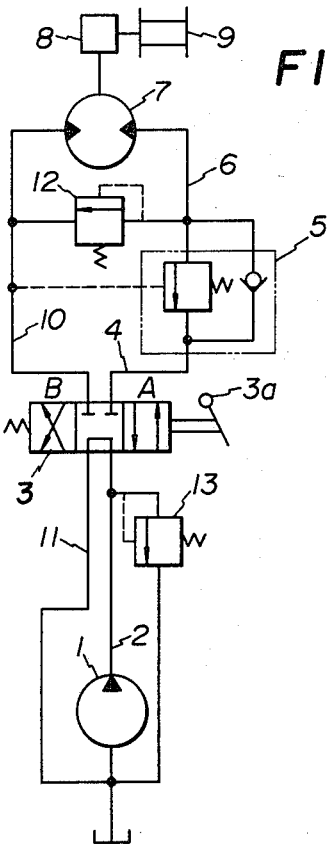
FIG. 1
FIG. 3
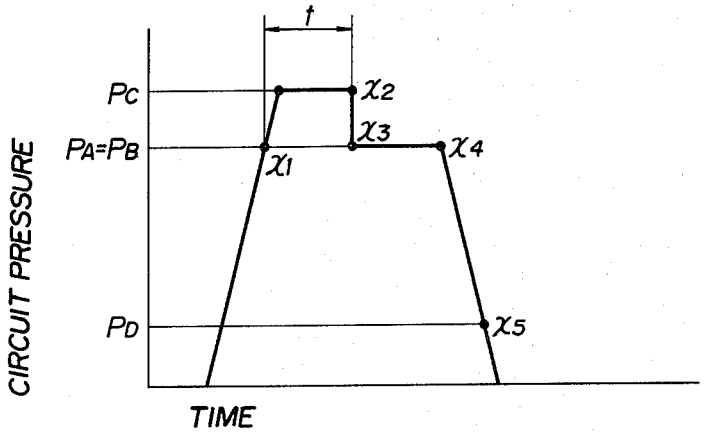

HYDRAULIC DRIVE CIRCUIT FOR LOAD-HANDLING MACHINES

BACKGROUND OF THE INVENTION (1) Field of the Invention

This invention relates to a hydraulic drive circuit for load-handling machines such as hydraulic crawler cranes, shovels and the like.

(2) Description of Prior Art

In a hydraulic load-handling machine, the rated presssure of the drive circuit is determined in consideration of the nature of various jobs performed by the machine. However, in actual operations, there sometimes occurs a necessity for a power greater than the rated pressure, for instance, when extracting an implanted, pile, when pulling a dragline bucket which is caught on a big stone or when getting a machine out of a muddy spot. In such a case, a mechanical load-handling machine can produce an instantaneously increased output (for a few seconds) corresponding to 130% to 150% of nornal output, due to the inertia force of the engine flywheel, but the hydraulic counterpart, the maximum output of which is determined by the relief pressure of the main relief valve is incapable of producing a surge of power exceeding that permitted by the rated pressure and thus is considered to have a smaller winch power as compared with its mechanical counterpart.

In order to increase the output of a hydraulic load-handling machine, it is possible to raise the reduction ratio between the hydraulic motor and the winding drum or to raise the relief pressure of the relief valve of the drive circuit. However, the increase of the reduction ratio, not accompanied by an increase of the pump capacity, results in a lower operating speed, and increases in the pump and engine capacities and the reduction ratio results in a higher production cost, noises and fuel consumption. In a case where the relief pressure of the main relief valve is elevated, it becomes necessary to employ a hydraulic pump, motor and other components with higher pressure resistance, also resulting in increased production costs. If the relief pressure of the main relief valve alone is increased regardless of the capacities of the respective hydraulic components, there invariably arise problems of insufficient service life and durability of the hydraulic components.

SUMMARY OF THE INVENTION

It is therefore an object of the present invention to provide a drive circuit for a hydraulic load-handling machine, which has the maximum output pressure thereof normally determined by a main relief valve but which, when necessary, is capable of automatically producing a surge of power corresponding to 130% to 150% of a rated output in a manner similar to a mechanical drive.

It is another object of the present invention to provide a drive circuit for a hydraulic load-handling machine, which is capable of producing an increased output power higher than that permitted by the rated output pressure but allows use of hydraulic components including a hydraulic pump and motor which are designed for the rated pressure.

It is still another object of the present invention to provide a drive circuit for a hydraulic load-handling machine, which is capable of producing an output higher than a rated pressure with use of an engine of a capacity designed for that rated pressure, without causing engine stops.

In order to achieve the above-mentioned objects, the present invention provides a hydraulic drive circuit in which the relief pressure of the main relief valve is increased for a predetermined short time period, for example, for a few seconds to a level equivalent to 130% to 150% of a rated pressure of the circuit, thereafter the relief pressure being automatically returned to the level of the rated pressure. In this instance, due to the inertia force of the flywheel, the engine torque is temporarily increased to a value greater than the rated torque but returns to the rated torque curve before reaching a maximal point. Therefore, the output pressure can be increased temporarily to produce a surge of power without causing an engine stop. Since the output pressure is soon returned to the level of the rated pressure, there is no possibility of impairing the service life and durability of hydraulic components.

The above and other objects, features and advantages of the invention will become apparent from the following description and appended claims, taken in conjunction with the accompanying drawings which show by way of example preferred embodiments of the invention.

BRIEF DESCRIPTION OF THE DRAWINGS

In the accompanying drawings:

FIG. 1 is a circuit diagram of a conventional drive circuit for hydraulic load-handling machines;

FIG. 3 is a graphical illustration explanatory of the operating principles of the present invention;

DESCRIPTION OF PREFERRED EMBODIMENT

Figure 2:
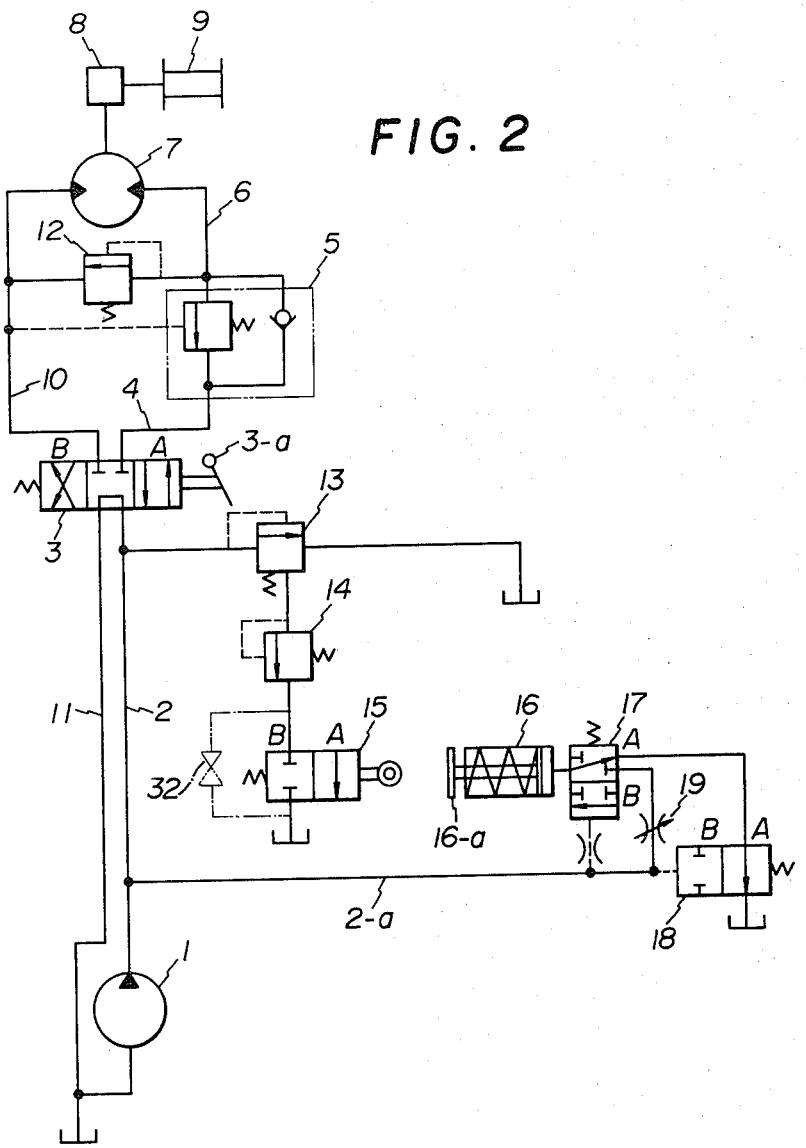
FIG. 2 is a diagram of a hydraulic drive circuit according to the present invention.

Before going into a detailed description of preferred embodiments of the present invention, reference is first had to FIG. 1 which shows a conventional hydraulic drive circuit for a hydraulic working vehicle, more particularly, a hydraulic hoisting circuit.

Referring to FIG. 1, the conventional hoisting circuit includes a hydraulic pump 1, a change-over valve 3, a counter-balancing valve 5, a hydraulic motor 7, a reducer 8, a winding drum 9, a shock relief valve 12 and a main relief valve 13. The hydraulic motor 7 is driven by the oil which is fed from the pump 1 through conduits 2 and 4, counter-balancing valve 5 and conduit 6 upon shifting the change-over valve 3 to position A. The oil leaving the motor 7 is returned to a tank through conduit 10, valve 3 and conduit 11. The counter-balancing valve 5 is provided for preventing a hoisted load from dropping during a lowering operation, and the shock relief valve 12 for cutting out high pressures which are generated in the conduit 6. The hydraulic motor 7 is connected to the winding drum 9 through the reducer 8 to drive the drum with a winding force corresponding to the motor drive torque which is produced by the relief pressure as determined by the main relief valve 13. As mentioned hereinbefore, it has been impossible to obtain a winding force greater than that permitted by the relief pressure determined by the main relief valve 13.

Referring now to FIG. 2, there is shown a drive circuit according to the present invention. In FIG. 2, the component parts 1 to 13 are same as the corresponding component parts in FIG. 1 and thus designated by corresponding reference numerals. In this embodiment, the relief pressure $P_C$ of a main relief valve 13 is set, for example, at a level equivalent to 130% to 150% of the rated pressure $P_A$ of the circuit, and a vent relief valve 14 which is set at a relief pressure $P_B(=P_A)$, equivalent to the rated pressure, is connected to a vent port of the main relief valve 13, connecting a tank port of the vent relief valve 14 with the tank through the change-over valve 15. The change-over valve 15 normally blocks the tank port of the vent relief valve 14 and, when switched, places the tank port of the vent relief valve 14 in communication with the tank.

Indicated at 16 is a cylinder with a piston 16-*a* for operating the changeover valve 15, at 17 a changeover valve for controlling the piston-cylinder 16, at 18 a change-over valve for delayed return, and at 19 a flow regulator valve. The change-over valve 17 detects the pressure of the circuit through a branched conduit 2-*a* and, when the circuit pressure reaches the rated pressure $P_A$, is shifted from position A to position B, causing the piston 16-*a* to move to the left, as seen in FIG. 2, at a speed which is regulated by the regulator valve 19. In the meantime, the delayed return valve 18 which detects the pressure of the circuit also through the branched conduit 2-*a* is already shifted to position B at a pressure appreciably lower than the rated pressure $P_A$.

In this embodiment with the above-described circuit arrangement, the controlling change-over valve 17 is shifted to position B when the circuit pressure reaches the rated pressure $P_A$ pushing out the piston 16-*a* at a speed regulated by the regulator valve 19 to shift the change-over valve 15 from position B to position A. In this embodiment, the relief pressure of the main relief valve 13 is set at a level $P_C$ higher than the rated pressure $P_A$ of circuit as mentioned hereinbefore and the tank port of the vent relief 14 is normally blocked by the switch valve 15, so that, during the time period between two time points, viz, the time point when the circuit pressure reaches the rated pressure $P_A$ and the time point when the change-over valve 15 is shifted to position A, the circuit pressure is raised up to the preset relief pressure $P_C$ of the main relief valve 13 and, upon shift to position A of the change-over valve 15, the circuit pressure is automatically dropped to the level $P_B=P_A$ since the relief pressure of the vent relief valve 14 is preset at the level of the rated pressure $P_A$. That is to say, in the present embodiment, a surge of power or an increased output can be obtained from the increased circuit pressure for the afore-mentioned time period by presetting such that the change-over valve 15 is shifted to position A within 2 to 5 seconds after the circuit pressure reaches the rated pressure $P_A$. The output is raised only for the preset time period and after that automatically drops to the rated pressure, so that there is no possibility of engine stops or impairment of the service life or reliability of the hydraulic component parts. In the case where the delayed return change-over valve 18 is set to be shiftable at a pressure $P_D$ as low as 10 kg/cm$^2$, the piston 16-*a* is unable to return to its initial position and the change-over valve 15 remains in position A even when the circuit pressure $P_C$ is returned to the level of $P_B=P_A$ after producing an increased output for the surge of power, the circuit pressure returning to the initial level only when dropped below the above-mentioned level $P_D$ without rising above the relief pressure $P_B$.

The above-explained operation is illustrated in FIG. 3. The piston 16-a starts to move when the circuit pressure is increased to the level of $P_A(=P_B)$ or the point $x_1$. For the time period of t seconds in which the switch valve 15 is shifted to position A or during the time period of movement of the piston 16-*a*, the main relief valve 13 retains the relief pressure $P_C$ and, when the change-over valve 15 is shifted to position A after t seconds, the circuit pressure is dropped to the level of relief pressure $P_B$ of the vent relief valve 14 from point $x_2$ to $x_3$, retaining the pressure $P_B(x_3x_4)$ continuously unless there is a change in load condition.

If the circuit pressure is dropped to $P_D$ due to a reduction of load, the low change-over valve 18 is returned to position A and the piston 16-*a* is moved to the right, allowing the change-over valve 15 to return to position B. Thus, the relief pressure of the circuit is reset at the relief pressure $P_C$ of the main relief valve 13, the circuit pressure being increased again to the level of $P_C$ upon application of an increased load.

Figure 4:
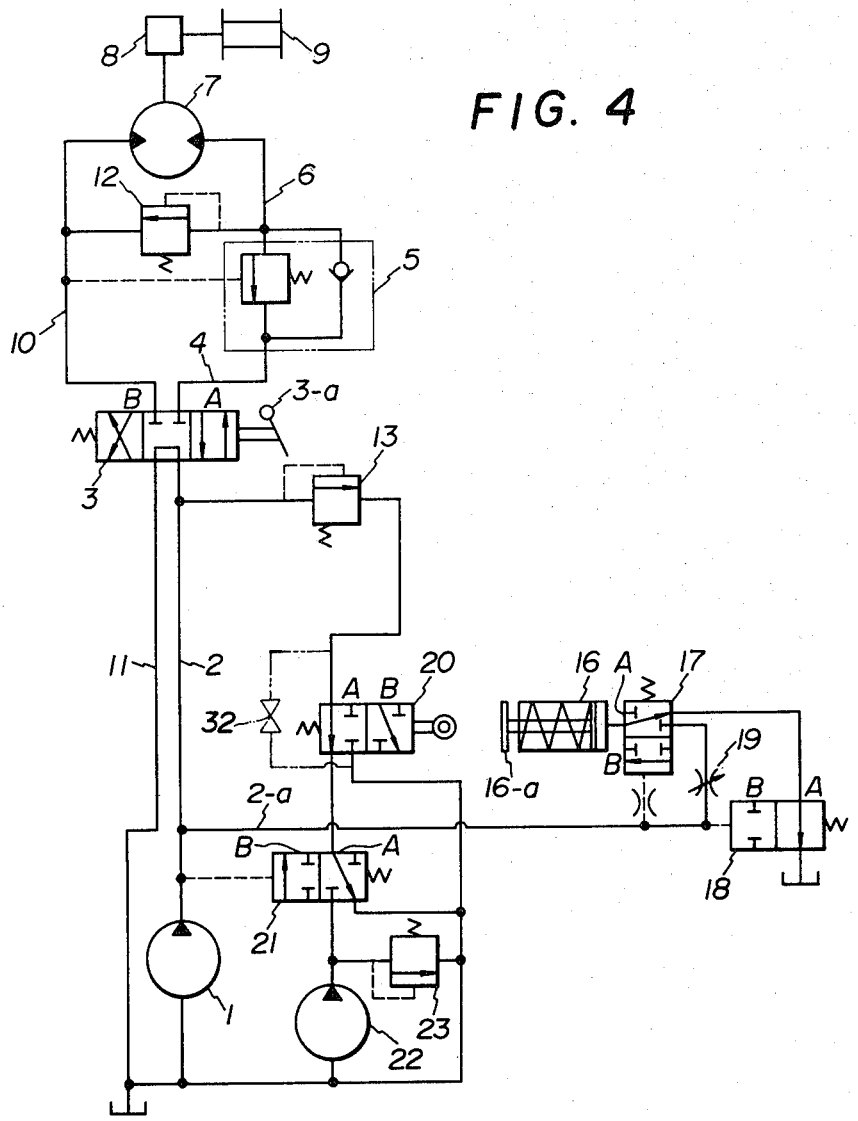
FIG. 4 is a circuit diagram of another embodiment of the present invention.

FIG. 4 shows a circuit diagram of another embodiment of the present invention, in which the component parts 1 to 13 are same as the corresponding parts in FIG. 1 and thus designated by corresponding reference numerals. In this embodiment, the relief pressure of the main relief valve 13 is set at the level of the rated pressure $P_A$ of the circuit and a back pressure $P_E$ is constantly applied to a tank port of the main relief valve 13 to hold the relief pressure of the circuit at $P_C=P_A+P_E$. When the circuit pressure exceeds the rated pressure, the back pressure $P_E$ is cut off after a lapse of a predetermined time period to increase the maximum circuit pressure to the level $P_C$ for that time period. Thereafter, the circuit pressure is automatically returned to the relief pressure $P_A$ of the main relief valve 13. In other respects, the circuit arrangement is same as in the first embodiment of FIG. 2.

More particularly, in FIG. 4, indicated at 20 is a change-over valve, at 21 is a change-over valve which is automatically switched in response to the pressure of the main circuit, at 22 an auxiliary pump for the back pressure, and at 23 a relief valve for the back pressure circuit. For example, the change-over valve 21 is shiftable to position B at a pressure level as low as 10 kg/cm$^2$ and the relief valve 23 for the back pressure is set to have a relief pressure $P_E$ which is about 30% to 50% of the rated pressure. Other component parts 16 to 19 are arranged in the same manner as the embodiment of FIG. 2.

In this embodiment with the above-described circuit arrangement, the change-over valve 21 is shifted from position A to B by pressure $P_D$ upon starting the oil pump 1, and pressure $P_E$ of the back pressure pump 22 which is set by the relief valve 23 is applied to the tank port of the main relief valve 13 through the change-over valves 21 and 20. Therefore, the relief pressure of the main relief valve 13 is set at $P_A+P_E=P_C$.

Now, if the circuit pressure reaches the rated pressure $P_A$, the piston 16-*a* is moved to the left at a speed as regulated by the flow regulator valve 19 in the same manner as in the embodiment of FIG. 2, while the circuit pressure is raised to the level $P_C$ and the changeover valve 20 is switched from position A to B by the piston 16-*a*, whereupon the tank port of the main relief valve 13 is connected with the tank to limit the maximum pressure of the circuit to relief pressure $P_A$. In this embodiment, the change-over valve 20 is also retained in position B until the circuit pressure drops below the preset switching pressure level $P_D$ of the slow change-over valve 18 which is preset, for example, at about 10 kg/cm$^2$.

Figure 5:
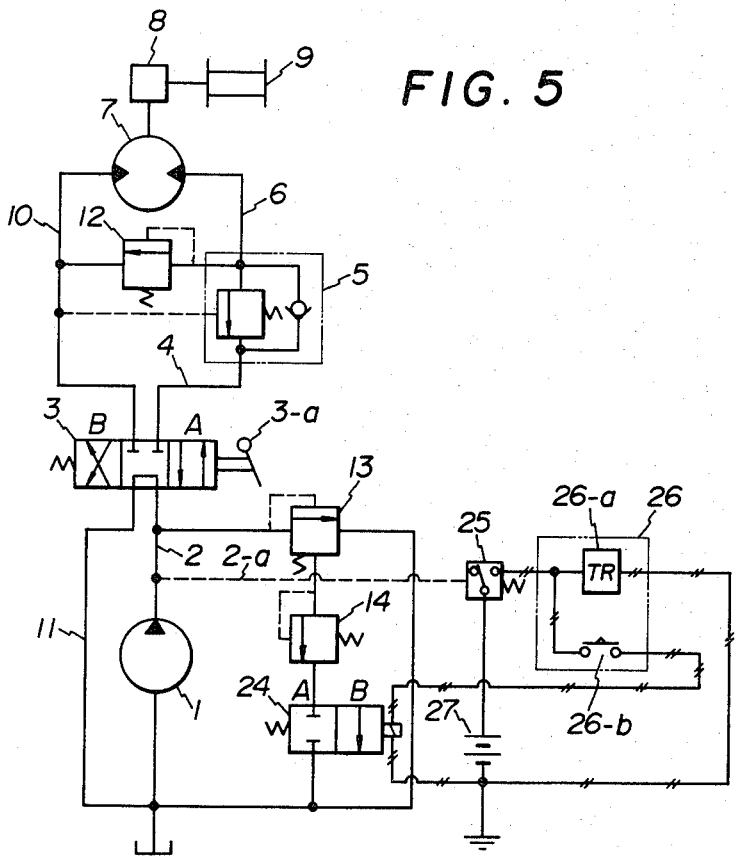
FIGS. 5 and 6 are diagrams of modifications of the embodiment shown in FIG. 2.

FIG. 5 illustrates a circuit diagram of an example for electrically controlling the embodiment of FIG. 2. In FIG. 5, the component parts 1 to 14 are same as the corresponding component parts in FIG. 2 and thus disignated by corresponding reference numerals. The change-over valve 15 of FIG. 2 is replaced by an electromagnetic change-over valve 24. Denoted at 25 is a pressure switch which is connected with a conduit 2-*a* branched from the conduit 2 and which closes upon detecting the circuit pressure reaching a level $P_E$ slightly lower than the rated pressure $P_A$, and at 26 a delay relay having a delay relay element 26-*a* and a relay switch 26-*b*, energizing the electromagnetic valve 24 by connection to a power source 27 when the relay switch 26-*b* is closed, for shift from position A to B. The delay relay 26 closes the relay switch 26-*b* after predetermined timer period, for example, a few seconds, after closing the pressure switch 25.

In the embodiment of FIG. 5 with the above-described arrangement, the pressure switch 25 is closed when the circuit pressure reaches the level $P_E$ and, after a predetermined time period which is preset for the delay relay 26, for example, after a few seconds, the relay switch 26-*b* is closed to shift the electromagnetic valve 24 from position A to B. Thus, the circuit pressure is raised from the rated pressure to an increased level $P_C$ for the delay time period of the relay 26, and then automatically dropped to the rated pressure.

The pressure $P_E$ which is detected by the pressure switch 25 has to be $P_E < P_A$ for the reason set forth below. In FIG. 3, the pressure switch 25 of FIG. 5 is closed during the time period of t seconds holding the pressure $P_C$ but the electromagnetic valve is in position A since the relay switch 26-*b* is open. Upon reaching point $x_2$ (FIG. 3), the relay switch 26-*b* is closed and the electromagnetic valve 24 is switched to position B, so that the main circuit pressure reaches point $x_3$ (FIG. 3). At this time, if $P_E = P_A$, the pressure switch 25 will be opened upon the circuit pressure reaching point $x_3$, again de-energizing the electromagnetic valve 24 to cause it to return to position A. As a result, pressure $P_C$ is repeatedly dropped every t seconds, creating a state as if pressure $P_E$ is continuously maintained.

However, in the embodiment shown in FIG. 5, the pressure switch 25 is opened immediately when the circuit pressure drops below the pressure $P_E$, so that the electromagnetic valve 24 is de-energized to return to position A and the relief pressure of the circuit is reset at the relief pressure $P_C$ of main relief valve 13. In this case, there is a possibility that the maximum pressure $P_C$ will be used with a great frequency.

Figure 6:
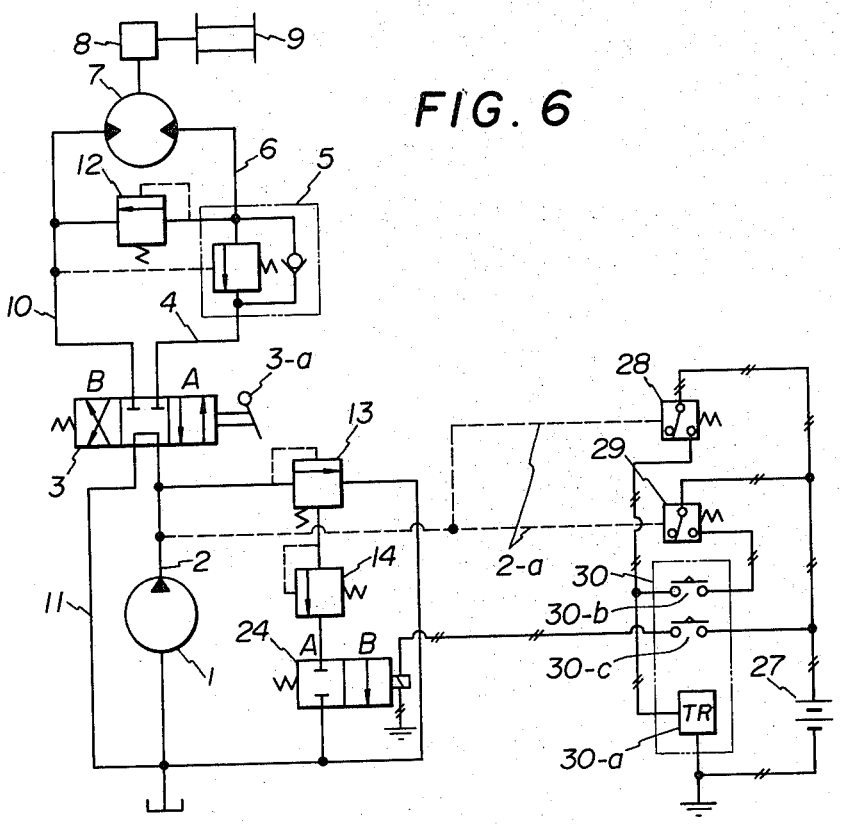

The modification of FIG. 6 overcomes this problem. In this modification the electromagnetic valve returns to position A only when the circuit pressure drops a level $P_D$ as low as 10 kg/cm$^2$.

In FIG. 6, the component parts 1 to 14 and 24 are same as the corresponding parts in FIG. 5 and thus designated by corresponding reference numerals. In this embodiment, the drive circuit employs a pressure switch 28 which closes upon detecting the circuit pressure reaching a level equivalent to or above the rated pressure and another pressure switch 29 which closes upon detecting the circuit pressure reaching a low level of about 10 kg/cm$^2$. A delay relay 30 which consists of a delay relay element 30-*a* and two relay switches 30-*b* and 30-*c* closes the pressure switch 28 to energize the delay relay element 30-*a* immediately when the circuit pressure reaches the rated pressure $P_A$ and after a delay of a few seconds closes the relay switches 30-*a* and 30-*b* to shift the electromagnetic valve 24 connecting the circuit of the delay relay element 30-*a* with the power source 27 through the pressure switch 29 and one relay switch 30-*a*.

In the embodiment of FIG. 6 with the above-described arrangement, if the electromagnetic valve 24 is shifted to position B after the circuit pressure is once elevated to the level $P_C$ above the rated pressure, energization of the delay relay switch element 30-*a* is maintained through the pressure switch 29 and relay switch 30-*b* unless the circuit pressure drops below the preset switching pressure $P_D$ of the pressure switch 29. It is only when the circuit pressure drops below the level $P_D$ that the pressure switch 29 is opened to return the electromagnetic valve 27 so that the frequency of using the maximum pressure $P_C$ is limited to some extent.

As described hereinbefore, in the embodiments of FIGS. 2, 4 and 6, the circuit pressure is temporarily raised above the rated pressure to increase the output for a surge of power and after that a pressure elevation over the rated pressure is not allowed unless the circuit pressure first drops below a predetermined low level $P_D$. Therefore, in normal operations, there is no possibility of the hydraulic components being subjected intermittently to a load greater than the rated pressure. However, in a case where a large output is required repeatedly, the surge pressure $P_C$ above the rated pressure can be produced again within a short period of time by manipulating an operating lever to lower the circuit below the level $P_D$ after once producing the surge pressure $P_C$. However, if the surge power $P_C$ is produced repeatedly with a high frequency, there arises a possibility of impairing the service life and reliability of the hydraulic components or of engine stops.

Figure 7:
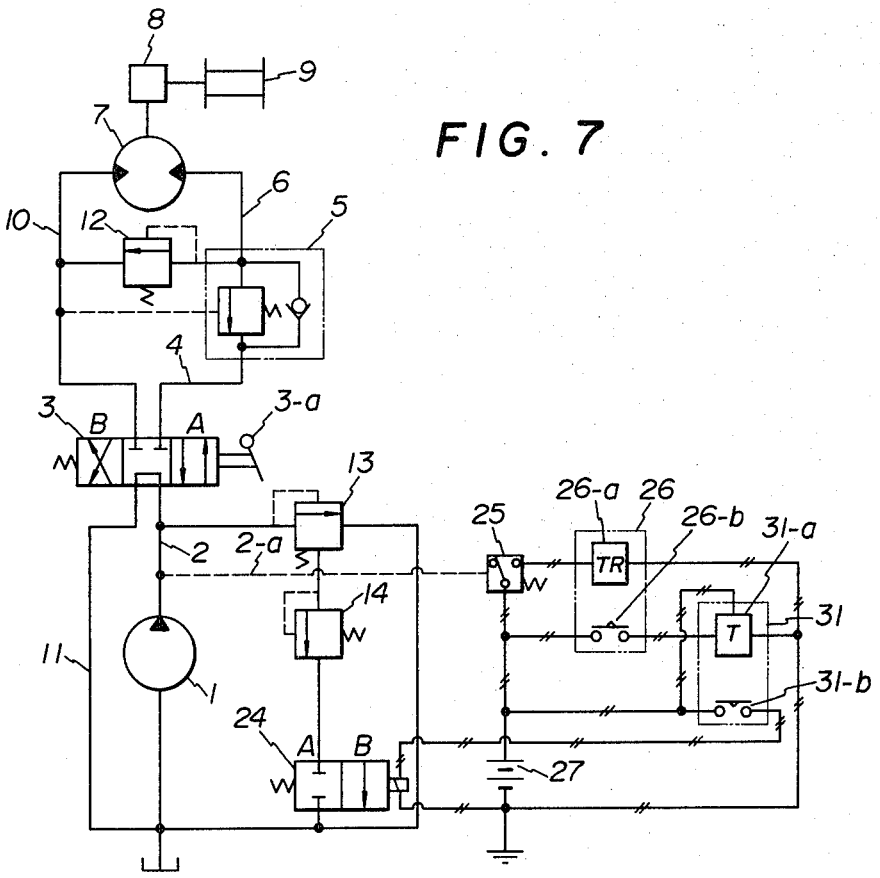
FIG. 7 is a circuit diagram of a further embodiment of the invention.

In consideration of this possibility, the embodiment of FIG. 7 is provided with means for preventing the generation of the surge of power for a time period necessary for safety once the circuit pressure is raised above the rated pressure, regardless of the pressure level of the circuit and external manipulations.

In FIG. 7, the component parts 1 to 14 and 24 to 27 are respectively same as the corresponding component parts which are designated by similar reference numerals in FIG. 5. In this embodiment, a timer element 31-*a* of a timer 31 which has a delayed restoration characteristic is connected in series with the relay switch 26-*b* of the delay relay 26, with a delayed restoration timer switch 31-*b* inserted in the circuit of the electromagnetic change-over valve 24.

In the embodiment of FIG. 7 with the above-described arrangement, the pressure switch 25 is closed when the circuit pressure reaches the rated pressure $P_A$, thereby actuating the delay relay 26 for elevating the circuit pressure from $P_A$ to $P_C$ for a few seconds. Thereafter, the relay switch 26-*b* is closed to shift the electromagnetic valve 24 to return the circuit pressure to the rated pressure $P_A$. In this instance, even if the pressure switch 25 is opened by a drop of the circuit pressure, the timer switch 31-*b* maintains the circuit of the electromagnetic valve 24 in the closed state for a preset time, for example, for thirty or forty seconds, preventing a pressure increase over the rated pressure for the preset time of the delayed restoration timer 31 regardless of the circuit pressure level. Therefore, by presetting the delayed restoration timer at a time period necessary for safe operation, for instance, at some tens of seconds, it becomes possible to limit the frequency of subjecting the hydraulic components to a high load for maintaining the durability and reliability of the hydraulic components.

Figure 8:
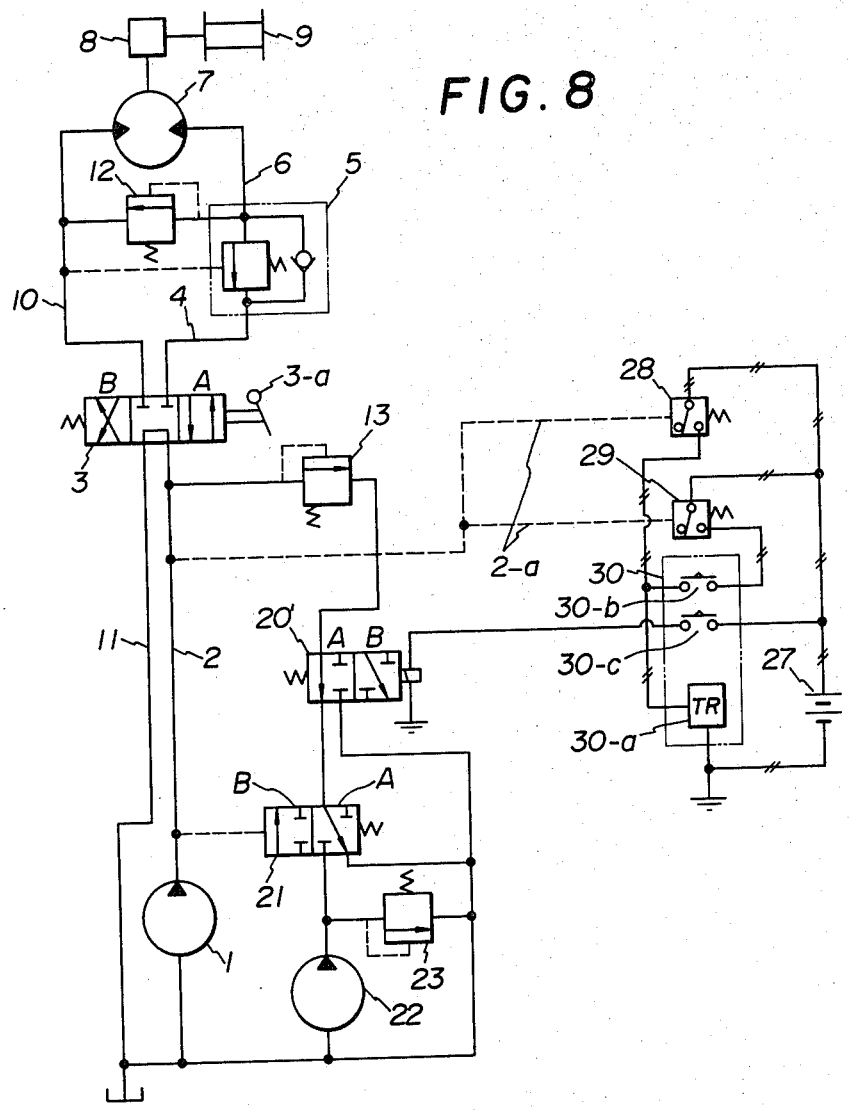
FIGS. 8 and 9 are circuit diagrams of modifications of the embodiment of FIG. 4.
Figure 9:
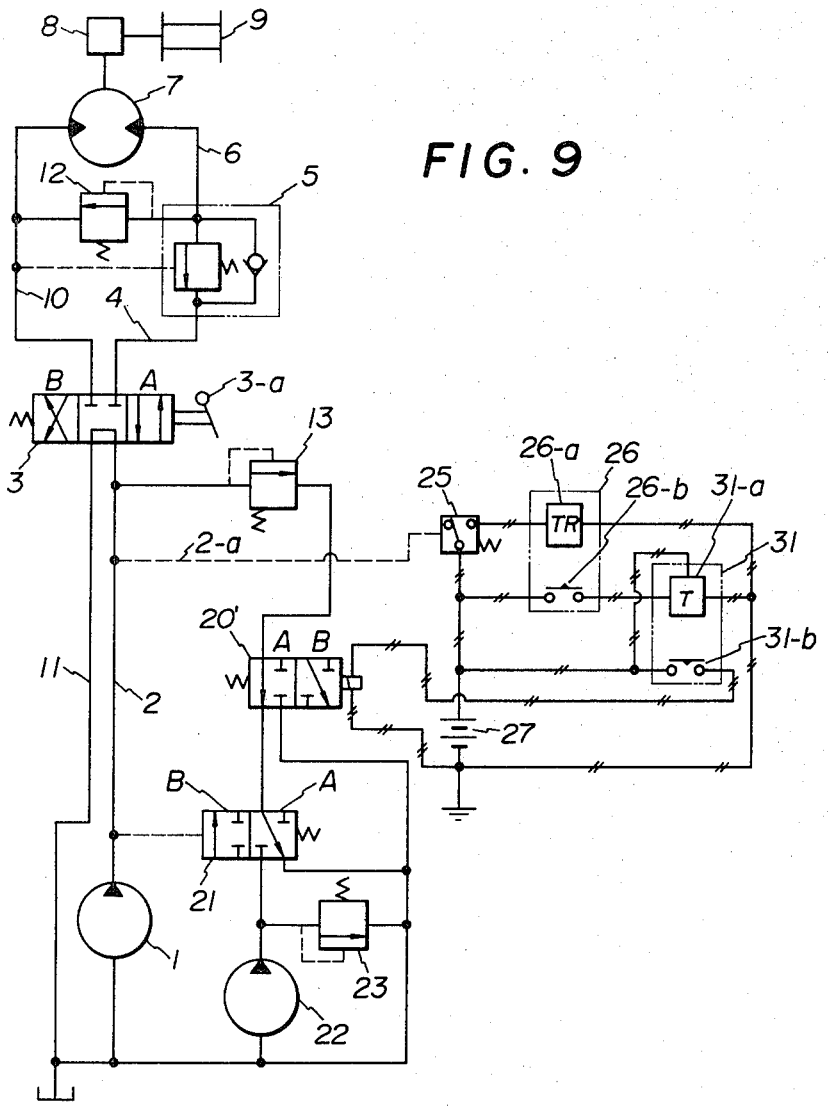

FIGS. 6 and 7 show electric controls for the drive circuit of FIG. 2. Similarly, the drive circuit of FIG. 4 can also be electrically controlled. More particularly, FIG. 8 illustrates an example for electrically controlling the drive circuit of FIG. 4 in a manner similar to FIG. 6, while FIG. 9 illustrates an example for electrically controlling the drive circuit of FIG. 4 in a manner similar to FIG. 7. In any case, the respective pressure switches and delay relay or delayed restoration timer operate in the same way as in FIGS. 6 and 7 and they are indicated by like reference numerals. Therefore, the explanation of the embodiments of FIGS. 8 and 9 is omitted herein to avoid repetitions.

As discussed hereinabove, in a hydraulic drive circuit in which the maximum output pressure is determined by a main relief valve provided on the delivery side of a hydraulic pump, the present invention provides an improvement in which the relief pressure of the main relief valve is automatically raised above the rated pressure of the circuit for a short time period of a few seconds and then also automatically returned to the rated pressure to obtain a surge of power greater than the rated output with use of hydraulic components for the rated pressure, including a hydraulic pump, motor and the like, while precluding the impairment of the durability and reliability of the hydraulic components as well as the trouble of engine stops.

The preferred embodiments of the invention have been described and illustrated by way of circuit diagrams. However, it is to be understood that the vent relief valve or other change-over valves can be provided either separately or integrally with the main relief valve.

Further, the flow regulator valve 19 is shown in FIGS. 2 and 4 as a variable throttle valve but it is not limited to a variable throttle valve and may be, for example, a distributing valve which has one outlet in communication with the oil tank.

Moreover, there may be provided a by-pass conduit with an on-off valve 32 as indicated by broken line in FIGS. 2 and 4 for unloading the working oil on the upstream side of the change-over valve 15 or 20, closing the valve 32 in an operation requiring a surge of power. If no surge of power is required in driving a hydraulic load-handling machine such as a crane, the valve 32 is held open.

What is claimed is:

1. A drive circuit for a hydraulic load-handling machine comprising a hydraulic pump, a main relief valve provided on the delivery side of said hydraulic pump for determining the maximum output pressure of said drive circuit and means for raising the relief pressure of said main relief valve above a rated pressure of said circuit for a short time period of about a few seconds and then automatically returning said relief pressure to a level equivalent to said rated pressure.

2. A drive circuit for a hydraulic load-handling machine as set forth in claim 1, in which said main relief valve has the relief pressure thereof set at a level higher than said rated pressure of the circuit, and said drive circuit has a vent relief valve set at said rated pressure and connected to a vent port of said main relief valve, said vent relief valve having a tank port, said relief pressure raising means normally blocking said tank port and opening said tank port so as to place it in communication with a tank after a predetermined time after the pressure of said circuit reaches said rated pressure, thereby allowing the circuit pressure to be elevated above said rated pressure during said predetermined time and to return automatically to a level equivalent to said rated pressure when said tank port of said vent relief valve is opened.

3. A drive circuit for a hydraulic load-handling machine as set forth in claim 2 in which said relief pressure raising means comprises a changeover valve for opening and closing said tank port of said vent relief valve, a control changeover valve connected to said circuit for being shifted when the circuit pressure reaches the level of said rated pressure, a piston mechanism having an inlet connected to said control changeover valve to be operated in response to the shift thereof said piston mechanism being connected to said control changeover valve for shifting said control changeover valve, a flow regulator valve in communication with said control changeover valve for delaying the time of shifting of said control changeover valve for setting a time period in which said circuit pressure is maintained at a level higher than said rated pressure, and a delayed changeover valve provided in the discharge passage from said piston mechanism and operable in response to the pressure in said circuit for opening said discharge passage only when said circuit pressure is considerably elevated.

4. A drive circuit for a hydraulic load-handling machine as set forth in claim 2 in which said main relief valve has the relief pressure set at a level higher than the rated pressure of said circuit, and said drive circuit has a vent relief valve connected to a vent port of said main relief valve and set at said rated pressure, said vent relief having a tank port, and said relief pressure raising means comprises an electromagnetic changeover valve normally blocking said tank port, a delay relay connected to said electromagnetic changeover valve, a first pressure switch responsive to an elevation of said circuit pressure to the level of said rated pressure and connected to said delay relay for switching said electromagnetic valve to open said tank portion of said vent relief valve after passage of a predetermined time period, and a second pressure switch responsive to pressure in said drive circuit and connected to said relay for maintaining the circuit of said delay relay in a condition to hold said electromagnetic valve open until the circuit pressure drops to a level considerably lower than said rated pressure, thereby permitting said electromagnetic valve to return to the initial position only when said circuit pressure drops to a level determined by the response pressure for which said second pressure switch is set.

5. A drive circuit for a hydraulic load-handling machine as set forth in claim 1 in which said main relief valve has the relief pressure set at the rated pressure of said drive circuit and has a tank port, and said relief pressure raising means comprises means for applying a back pressure to said tank port to hold the relief pressure above the level of said rated pressure, and means to cut off said back pressure applied to said tank port to said main relief valve at the end of a predetermined time period after said circuit pressure reaches said rated pressure, thereby allowing the circuit pressure to be elevated above said rated pressure during said predetermined time and to return to the level of said rated pressure when said back pressure to said tank port of said main relief valve is cut of.

6. A drive circuit for a hydraulic load-handling machine is set for in claim 5 in which said relief pressure raising means comprises a changeover valve for controlling the application of said back pressure to said tank port of said main relief valve, a control changeover valve connected to said circuit for being shifted when the circuit pressure reaches the level of said rated pressure, a piston mechanism having an inlet connected to said control changeover valve to be operated in response to the shift thereof said piston mechanism being connected to said control changeover valve for shifting said control changeover valve, a flow regulator valve in communication with said control changeover valve for delaying the time of shifting of said control changeover valve for setting a time period in which said circuit pressure is maintained at a level higher than said rated pressure, and a delayed changeover valve provided in the discharge passage form said piston mechanism and operable in response to the pressure in said circuit for opening said discharge passage only when said circuit pressure is considerably elevated.

7. A drive circuit for a hydraulic load-handling machine as set forth in claim 6 in which said main relief valve has the relief pressure set at the level of said rated pressure and has a tank port, and said relief pressure raising means, comprises a back pressure applying means, an electromagnetic changeover valve connected between said back pressure applying means and said tank port for normally applying a back pressure to said tank port to make the relief pressure of said main relief valve higher than said rated pressure, a delay relay connected to said electromagnetic changeover valve, a first pressure switch responsive to an elevation of said circuit pressure to the level of said rated pressure and connected to said relay to switch said electromagnetic valve to cut off said back pressure to said tank port of said main relief valve after the passage of a predetermined time period preset by said delay relay, and a second pressure switch responsive to pressure in said drive circuit and connected to said relay for maintaining the circuit of said delay relay in a condition to hold said electromagnetic changeover valve closed unti said drive circuit pressure drops to a level considerably lower than said rated pressure, thereby permitting said electromagnetic valve to return to its initial position only when said circuit pressure drops to a level determined by the response pressure for which said second pressure switch is set.

8. A drive circuit for a hydraulic load-handling machine as claimed in claim 1 further comprising means connected to said relief pressure raising means for maintaining the relief pressure of the main relief valve at the level of said rated pressure during a predetermined time after the maximum pressure of the circuit has been raised above the rated pressure regardless of the pressure of the circuit.

9. A drive circuit for a hydraulic load-handling machine as set forth in claim 8 in which said main relief valve has a relief pressure set at a level higher than the rated pressure, and said drive circuit has a vent relief valve set at the level of said rated pressure and connected to a vent port of said main relief valve, said vent relief valve having a tank port, said relief pressure raising means comprises an electromagnetic changeover valve normally blocking said tank port, and a delay relay connected to electromagnetic changeover valve and a pressure switch responsive to an elevation of the drive circuit pressure to the level of said rated pressure and connected to said delay relay for switching said electromagnetic valve to open said tank port of said vent relief valve after the passage of a predetermined time period set by said delay relay and said further means comprises means connected to said delay relay for maintaining the circuit of said delay relay in condition for preventing said electromagnetic valve having once been switched by the operation of said pressure switch from returning to the initial position for a set time period regardless of restoration of said delay relay due to a drop of said drive circuit pressure.

10. A drive circuit for a hydraulic load-handling machine as set forth in claim 8 in which said main relief valve has the relief pressure set at the level of the rated pressure and has a tank port, and said relief pressure raising means comprises a back pressure applying means, an electromagnetic changeover valve connected between said back pressure applying means and said tank port for normally applying a back pressure to said tank port to make the relief pressure of said main relief valve higher than said rated pressure, a delay relay connected to said electromagnetic changeover valve, and a pressure switch responsive to an elevation of said circuit pressure to the level of said rated pressure connected to said relay to switch said electromagnetic valve to cut off the back pressure to said tank port of said main relief valve after the passage of a predetermined time period set by said delay relay, and said further means comprises means connected to said delay relay for maintaining the circuit of said delay relay in condition for preventing said electromagnetic valve having once been switched by operation of said pressure switch from returning to the initial position for a set time period regardless of the level of said drive circuit pressure.

* * * * *